United States Patent [19]

Bares

[11] Patent Number: 5,019,870

[45] Date of Patent: May 28, 1991

[54] TONER REMOVAL APPARATUS

[75] Inventor: Jan Bares, Webster, N.Y.

[73] Assignee: Xerox Corporation, Stamford

[21] Appl. No.: 503,598

[22] Filed: Mar. 26, 1990

[51] Int. Cl.[5] ..... G03G 21/00; G03G 15/06

[52] U.S. Cl. ..... 355/298; 355/245

[58] Field of Search ..... 355/245, 260, 259, 298; 118/657, 658

[56] References Cited

U.S. PATENT DOCUMENTS

| | | | |
|---|---|---|---|
| 4,361,396 | 11/1982 | Uchida | 355/15 |
| 4,427,289 | 1/1984 | Oda | 355/298 |
| 4,435,073 | 3/1984 | Miller | 355/298 X |
| 4,439,034 | 3/1984 | Daniels | 118/658 |
| 4,501,620 | 2/1985 | Oda | 355/298 X |
| 4,625,895 | 12/1986 | Tsukano | 222/63 |
| 4,666,282 | 5/1987 | Rowe | 355/245 X |
| 4,850,303 | 7/1989 | Cipolla et al. | 118/653 |
| 4,891,673 | 1/1990 | Buell | 355/245 |

FOREIGN PATENT DOCUMENTS 0091461 5/1984 Japan .

*Primary Examiner*—Fred L. Braun
*Assistant Examiner*—Nestor R. Ramirez

[57] ABSTRACT

An apparatus in which developer material is transported to the latent image. Toner particles are attracted from the carrier granules of the developer material to the latent image. The developer material is in a chamber of a housing and additional toner particles are supplied thereto. A portion of the toner particles are removed from the chamber of the housing. The average size of the toner particles removed from the housing chamber is greater than the average size of the toner particles remaining in the housing chamber.

16 Claims, 3 Drawing Sheets

TONER REMOVAL APPARATUS

This invention relates generally to a development apparatus used in an electrophotographic printing machine, and more particularly concerns an apparatus for removing toner particles from the development apparatus.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer mixture into contact therewith. A common type of developer material comprises carrier granules having toner particles adhering triboelectrically thereto. This two-component mixture is brought into contact with the photoconductive surface. The toner particles are attracted from the carrier granules to the latent image. This forms a toner powder image on the photoconductive surface which is subsequently transferred to a copy sheet. Finally, the toner powder image is heated to permanently fuse it to the copy sheet in image configuration.

High speed commerical printing machine of this type are used as magnetic ink character recognition printers (MICR) for printing checks. In a printing machine of this type, a magnetic brush development system is used for developing the latent image recorded on the photoconductive surface. The developer material uses highly magnetic toner particles. The magnetic retention forces on large toner particles is generally greater than the electrical development forces. This is due to the magnetic force holding the toner particles to the carrier granules being proportional to the third or second power of size while the electrostatic development force is proportional to the first power of size. This results in an accumulation of large toner particles in the chamber of the developer housing. As a result, the average size of the toner particles in the developer housing chamber increases to a level detrimental to development and, in particular, to print quality. It has been found that print quality improves significantly when the average size of the toner particles in the developer housing is maintained at an optimum level. Various techniques have been devised for removing toner particles, the following disclosures appear to be relevant:

U.S. Pat. No. 4,361,396, patentee: Uchida, issued: Nov. 30, 1982.

U.S. Pat. No. 4,625,895, patentee: Tsukano, issued: Dec. 2, 1986.

U.S. Pat. No. 4,850,303, patentee: Cipolla et al., issued: July 25, 1989.

U.S. Pat. No. 4,891,673, patentee: Buell, issued: Jan. 2, 1990.

The relevant portions of the foregoing disclosures may be briefly summarized as follows:

U.S. Pat. No. 4,361,396 discloses an apparatus for collecting scattered magnetic toner particles. A fan draws toner into a collecting chamber where it is attracted to magnets. A filter may be used to improve collection capacity and efficiency.

U.S. Pat. No. 4,625,895 describes a screw for transporting used developer material in a developer housing to a bottle. After the used developer material is removed from the developer housing, a fresh charge of developer material is provided.

U.S. Pat. No. 4,850,303 discloses a development system in which developer material is continually removed from the developer housing and transported through an exit port in the housing to a removable developer waste sump.

U.S. Pat. No. 4,891,673 describes a development system in which developer material is continually removed from a developer housing by passing through an exit port. A magnet is positioned adjacent the exit port to form a carrier bead curtain which prevents the passage of toner particles therethrough while permitting developer material and carrier granules to exit therefrom.

In accordance with one aspect of the present invention, there is provided an apparatus for developing an electrostatic latent image. The apparatus includes means for transporting developer material comprising at least carrier granules having toner particles adhering thereto to the electrostatic latent image. A housing has a supply of developer material in the chamber thereof. The transporting means is in communication with the chamber of the housing for receiving developer material. The housing has an exit port therein to discharge toner particles therefrom. Means are provided for supplying toner particles to the chamber of the housing. Means remove a portion of the toner particles from the chamber of the housing while preventing the removal of carrier granules therefrom with the average size of the toner particles being removed from the chamber of the housing being greater than the average size of the toner particles remaining in the chamber of the housing so as to reduce the accumulation of large toner particles in the chamber of the housing.

Pursuant to another aspect of the present invention, there is provided an electrophotographic printing machine of the type in which an electrostatic latent image recorded on a photoconductive member is developed with a developer material. The improvement includes means for transporting developer material comprising at least carrier granules having toner particles adhering thereto to the electrostatic latent image. A housing has a supply of developer material in the chamber thereof. The transporting means is in communication with the chamber of the housing for receiving developer material. The housing has an exit port therein to discharge toner particles therefrom. Means are provided for supplying toner particles to the chamber of the housing. Means remove a portion of the toner particles from the chamber of the housing while preventing the removal of carrier granules therefrom with the average size of the toner particles being removed from the chamber of the housing being greater than the average size of the toner particles remaining in the chamber of the housing so as to reduce the accumulation of large toner particles in the chamber of the housing.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
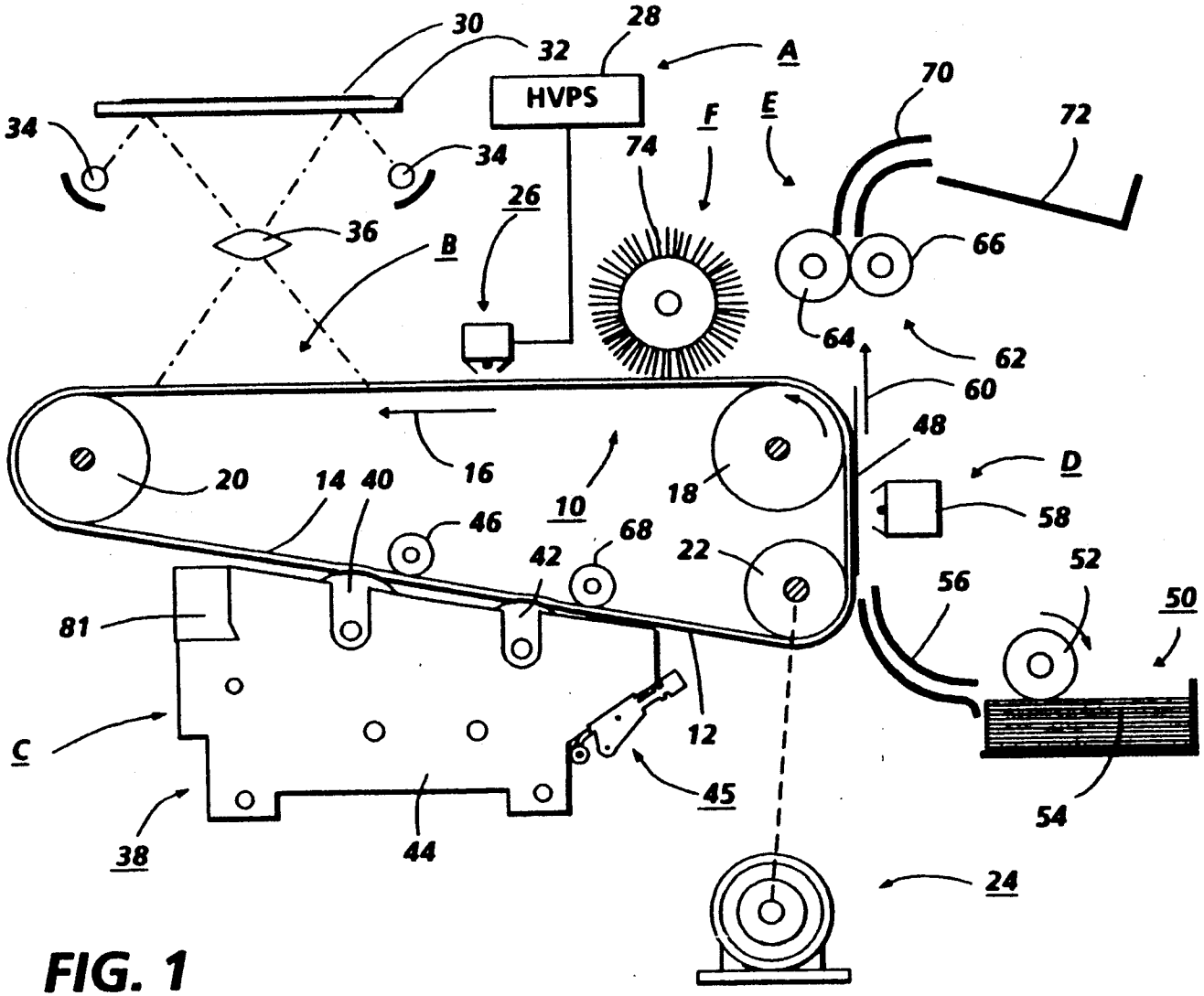
FIG. 1 is a schematic elevational view of an illustrative electrophotographic printing machine incorporating a development apparatus having the features of the present invention therein.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a magnetic brush development system, indicated generally by the reference numeral 38, advances developer material into contact with the latent image. Preferably, magnetic brush development system 38 includes two magnetic brush developer rollers 40 and 42. Rollers 40 and 42 advance developer material into contact with the latent image. These developer rollers form a brush of carrier granules and magnetic toner particles extending outwardly therefrom. The latent image attracts the magnetic toner particles from the carrier granules forming a toner powder image thereon. Developer rollers 40 and 42 are mounted, at least partially, in the chamber of developer housing 44. The chamber in developer housing 44 stores a supply of developer material therein. A toner removal apparatus, indicated generally by the reference numeral 45 is in communication with the toner in the chamber of housing 44. Toner removal apparatus 45 continuously removes large toner particles from the chamber of the developer housing to prevent the increase in average size of the toner particles. A toner container dispenses additional toner particles into the developer material in the chamber of the developer housing. These fresh toner particles are mixed with the developer material in the chamber of the developer housing. Removing large toner particles and adding smaller toner particles to the chamber of the developer housing prevents the increase in the average size of the toner particles therein. The development apparatus of the present invention will be described hereinafter in greater detail with reference to FIGS. 2 and 3. Guide rollers 46 and 68 deflect belt 10 so that a portion of belt 10 is wrapped about a region of the exterior circumferential surface of rollers 40 and 42 to form extended development zones about each of the developer rollers.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the magnetic toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the toner removal apparatus of the present invention therein.

Figure 2:
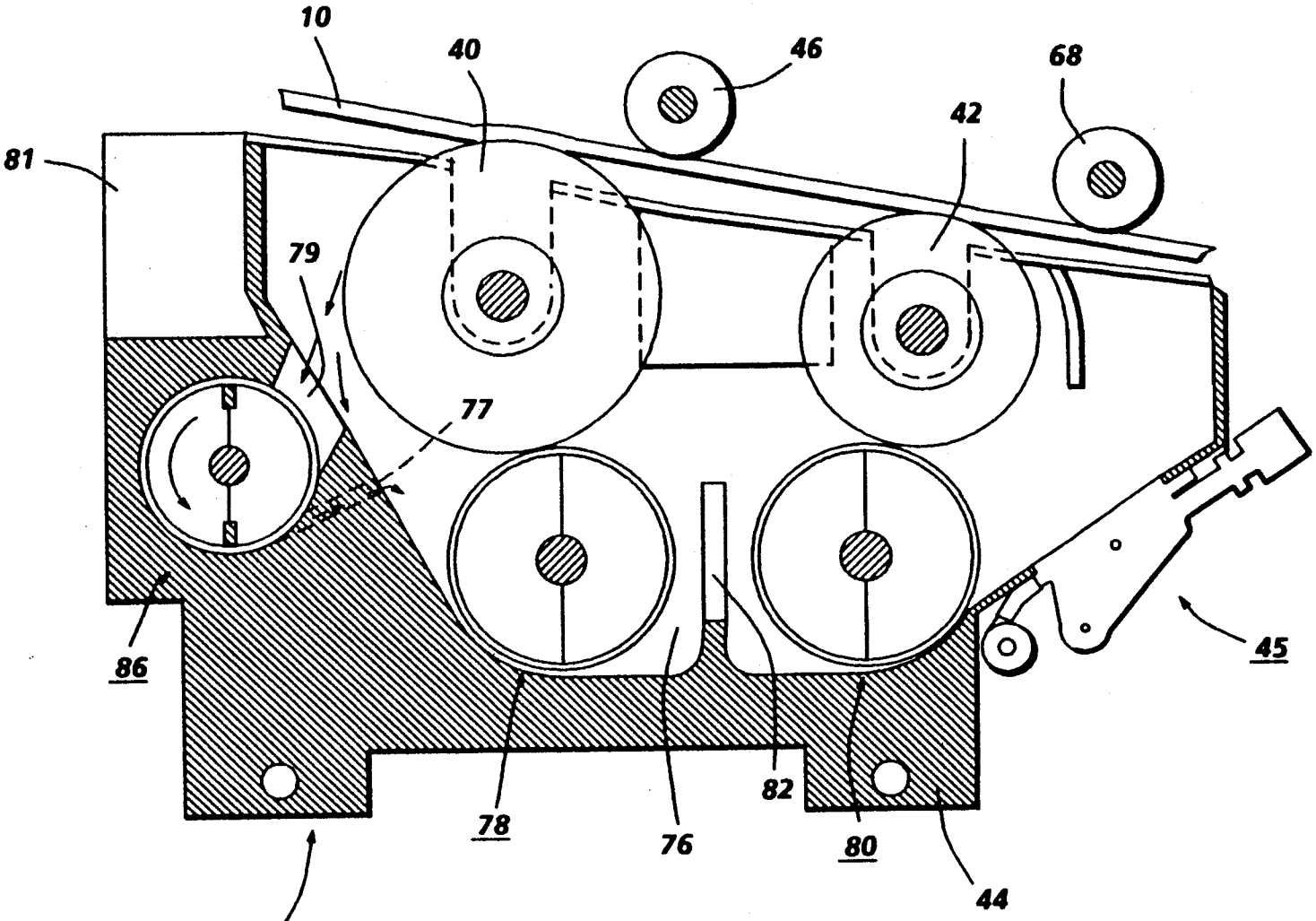
FIG. 2 is an elevational view, partially in section, showing the development apparatus used in the FIG. 1 printing machine.

Referring now to FIG. 2, there is shown development system 38 in greater detail. As shown thereat, development system 38 includes a housing 44 defining a chamber 76 for storing a supply of developer material therein. Developer rollers 40 and 42 are mounted in chamber 76 of housing 44 and positioned closely adjacent to belt 10, i.e. a portion of belt 10 is wrapped about developer rollers 40 and 42. Guide rollers 46 and 68 engage the backside of belt 10 and position belt 10 so that a portion thereof wraps about a region of developer roller 40 forming an extended development zone ranging from about 5° to about 25°. Another portion of belt 10 wraps about a region of developer roller 42 forming an extended development zone ranging from about 5° to about 25°. Preferably, developer rollers 40 and 42 each include a non-magnetic tubular member made preferably from aluminum and having the exterior circumferential surface thereof roughened. An elongated magnet is positioned interiorly of and spaced from the the tubular member. The magnet is mounted stationarily and generates a low magnetic field in the development zone to permit high agitation of the developer material thereat. The tubular member rotates to advance the developer material adhering thereto into the development zone where the toner particles are attracted from the carrier granules to the latent image recorded on photoconductive surface 12 of belt 10.

With continued reference to FIG. 2, augers, indicated generally by the reference numerals 78 and 80, are located in chamber 76 of housing 44. Augers 78 and 80 are substantially identical to one another. Each of the augers is mounted rotatably in chamber 76 to mix and transport developer material. Augers 78 and 80 rotate in opposite directions to advance the developer material in opposite directions. In this way, the developer material moves in a recirculating path. Auger 86 is mounted rotatably in an opening in the developer housing. New toner particles are discharged into the chamber of the developer housing from toner container 81. These toner particles are mixed with the developer material by auger 86. In this way, the developer material is mixed and dispersed. A plate or baffle 82 separates auger 78 from auger 80. The developer material moves gently between augers at the respective ends thereof. After development of the electrostatic latent image, a portion of the developer material on developer roller 40 passes through opening 79 onto auger 86 at one end thereof. The developer material is mixed as auger 86 moves the developer material in an axial and radial direction. Opening 77 is located at the other end of auger 86. Auger 86 moves the material from opening 79 to opening 77. The mixed developer material is discharged through opening 77 onto auger 78. Toner removal apparatus 45 continuously removes large toner particles from chamber 76 of housing 44. As toner particles are removed from chamber 76 of housing 44, additional toner particles are dispensed thereto from toner container 81. When highly magnetic toner particles are used to develop the latent image, the magnetic retention forces on the large toner particles generally exceed the the electrical development forces. This results in large toner particles remaining in the developer housing and not being attracted to the latent image. In this way, large toner particles accumulate in the developer housing. For example, a developer housing containing 5000 grams of developer material with 4% concentration of toner particles has 200 grams of toner in the chamber of the housing. In order to print 90 prints per minute, the toner container should dispense about 0.06 grams/-second of toner. Assuming that the newly supplied toner contains only two sizes, i.e. 99% by number of the toner is $9\mu$ in diameter and 1% by number of the toner is $18\mu$ in diameter, the number ratio of sizes, $K=99$, the number f average size, $d_n=9.1\mu$, and the volume average size, $d_v=9.2\mu$. Assuming that due to the large particle accummulation, the number ratio of sizes stabilizes at $K=2$, 67% of the toner particles will be $9\mu$ particles and 33% of the particles will be $18\mu$ particles. The size averages then become $d_n=12$ and $d_v=13.4$, respectively. If the removal of toner particles is equal to to 20% of the dispensing rate, 0.012 grams/second, even without preferential removal of large sizes, a much better toner population distribution is achieved. The size ratio will stabilize at about a $K=6.06$, i.e. 14% of the toner particles are $18\mu$ in diameter and 86% of the toner particles are $9\mu$ in diameter. Accordingly, the average sizes drop to a $d_n=11$ and a $d_v=11.3$, respectively. To compensate for the removal of toner particles, the dispensing rate from the toner container is adjusted to 0.072 grams/second instead of the 0.06 grams/second. The toner removal apparatus depicted in FIG. 3 is designed to remove toner particles without removing carrier granules from the chamber of the housing.

Figure 3:
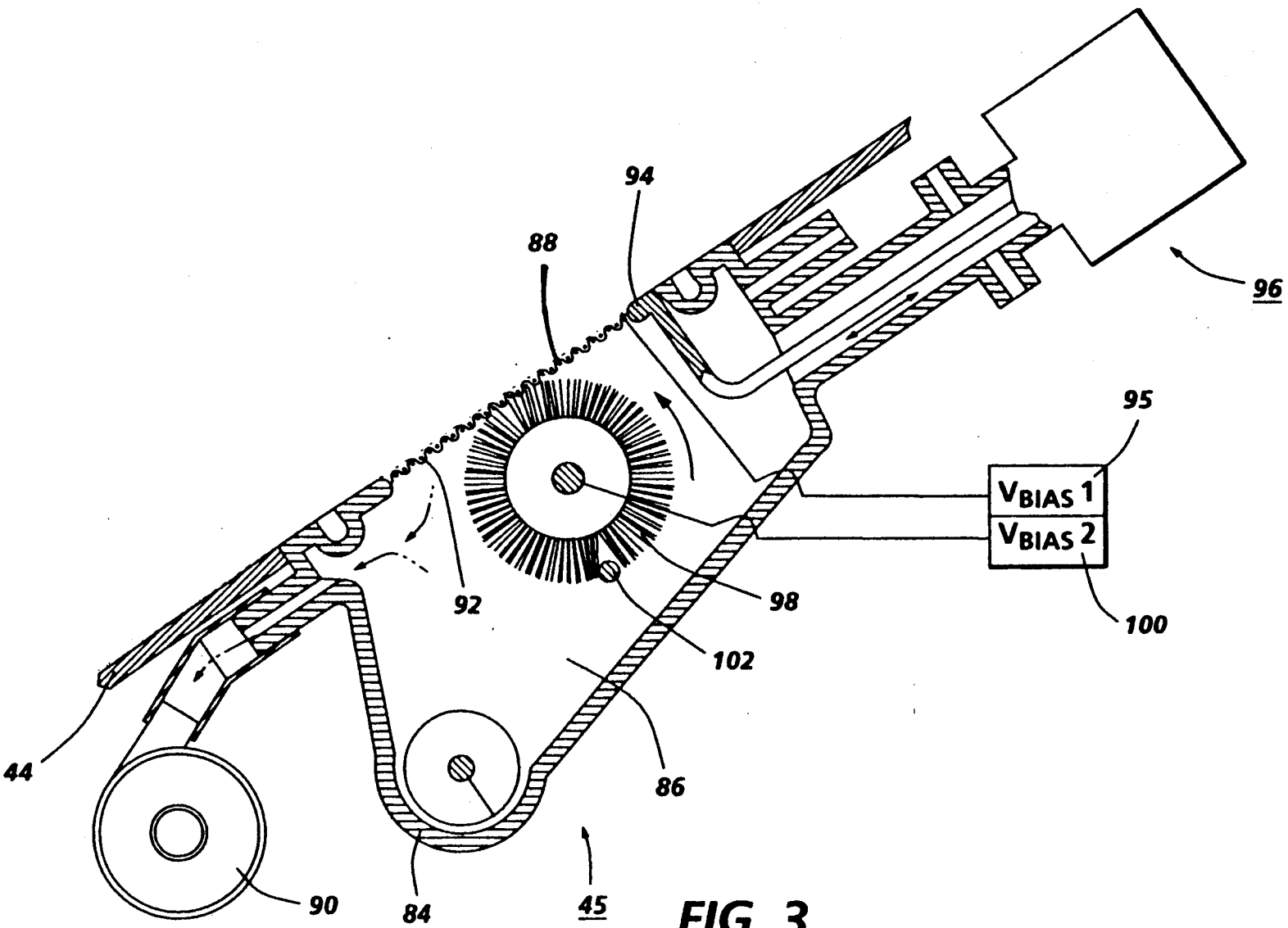
FIG. 3 is an elevational view of the apparatus used to remove large toner particles from the chamber of the developer housing shown in FIG. 2.

Turning now to FIG. 3, toner removal apparatus 45 has an enclosure 84 defining a chamber 86. Enclosure 84 is mounted on housing 44 covering exit port 88. A blower 90 is connected to enclosure 84 to reduce the internal pressure in chamber 86. The resulting air flow draws toner toward exit port 88 in housing 44. This air flow has the added benefit of limiting toner emissions from housing 44. Screen 92 is mounted in chamber 86 across exit port 88. The sieve of screen 92 is selected to be smaller than the size of the carrier granules and larger than the toner particles. Voltage source 95 electrically biases screen 92 to a suitable potential and magnitude to attract toner particles thereto. Wire screen 92 is molded in the middle of a flexible rubber membrane 94. An electromagnetic transducer, indicated generally by the reference numeral 96, is connected to rubber membrane 94. Energization of the electromagnetic transducer vibrates screen 92 to dislodge large and heavy toner particles developer material adjacent screen 92. A brush 98 is mounted rotatably in chamber 86 of enclosure 84. As brush 98 rotates in the direction of arrow 100, the brush fibers extending outwardly from the central region thereof contact screen 92. Voltage source 100 electrically biases brush 98 to a suitable magnitude and polarity. The electrically biased brush assists in the removal of toner particles from the vibrating screen. A flicker bar 102 is located in the path of rotation of the fibers on brush 98. the flicker bar contacts the fibers and flicks the brush fibers to dislodge toner particles therefrom. The dislodged toner particles fall from brush 98 into auger 104 which transports these toner particles to a waste container (not shown). The toner removal apparatus of the present invention uses inertial forces and aerodynamic drag to preferentially remove large toner particles rather than small toner particles. The inertial force is proportional to the cube of the diameter and the particle mass. The aerodynamic drag is approximately proportional to the square of the size or the cross section. By using these properties of the toner particles, the toner removing apparatus removes toner particles from the developer housing with the average size of the toner particles removed from the chamber of the developer housing being greater than the average size of the toner particles remaining in the housing chamber. In this way, the size of the toner particles remaining in the housing is optimized for development of the latent image.

In recapitulation, it is evident that the development apparatus of the present invention includes a toner removing apparatus which continually removes large toner particles from the developer housing. Smaller size toner particles are supplied to the developer housing to replace the toner particles removed. The preferential removal of large size toner particles from the developer housing results in the average size of the toner particles remaining in the developer housing being reduced to optimize development.

It is, therefore, apparent that there has been provided in accordance with the present invention, a development apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing an electrostatic latent image, including:

means for transporting developer material comprising at least carrier granules having toner particles adhering thereto to the electrostatic latent image;

a housing defining a chamber having a supply of developer material therein, said transporting means being in communication with the chamber of said housing for receiving developer material, said housing having an exit port therein to discharge toner particles therefrom;

means for supplying toner particles to the chamber of said housing; and means for removing a portion of the toner particles from the chamber of said housing through the exit port therein while preventing the removal of carrier granules with the average size of the toner particles being removed from the chamber of said housing being greater than the average size of the toner particles remaining in the chamber of said housing so as to reduce the accumulation of large toner particles in the chamber of said housing.

2. An apparatus according to claim 1, wherein said removing means includes an enclosure mounted on said housing over the exit port in said housing.

3. An apparatus according to claim 2, wherein said removing means includes:

a screen extending across the exit port in said housing and in said enclosure; and means for reducing the pressure in said enclosure relative to the pressure in the chamber of said housing so as to draw toner particles through said screen, said screen being substantially impervious to carrier granules so as to prevent the passage of carrier granules while permitting the passage of toner particles therethrough.

4. An apparatus according to claim 3, wherein said removing means includes means for vibrating said screen to free toner particles from carrier granules adjacent said screen.

5. An apparatus according to claim 4, wherein said removing means includes:

means for electrically biasing said screen to attract toner particles thereto from the developer material in the chamber of said housing; and means for assisting in the removal of toner particles from said screen.

6. An apparatus according to claim 5, wherein said assisting means includes a brush mounted rotatably in said enclosure and being adapted to contact said screen to dislodge toner particles therefrom.

7. An apparatus according to claim 6, wherein said assisting means includes means for electrically biasing said brush to attract toner particles from said screen.

8. An apparatus according to claim 7, wherein said removing means includes:

a bar positioned to engage said brush to dislodge toner therefrom; and an auger in communication with said enclosure to remove toner therefrom.

9. An electrophotographic printing machine of the type in which an electrostatic latent image recorded on a photoconductive member is developed with a developer material, wherein the improvement includes:

means for transporting developer material comprising at least carrier granules having toner particles adhering thereto to the electrostatic latent image;

a housing defining a chamber having a supply of developer material therein, said transporting means being in communication with the chamber of said housing for receiving developer material, said housing having an exit port therein to discharge toner particles therefrom;

means for supplying toner particles to the chamber of said housing; and means for removing a portion of the toner particles from the chamber of said housing through the exit port therein while preventing the removal of carrier granules therefrom with the average size of the toner particles being removed from the chamber of said housing being greater than the average size of the toner particles remaining in the chamber of said housing so as to reduce the accumulation of large toner particles in the chamber of said housing.

10. A printing machine according to claim 9, wherein said removing means includes an enclosure mounted on said housing over the exit port in said housing.

11. A printing machine according to claim 10, wherein said removing means includes:

a screen extending across the exit port in said housing and in said enclosure; and means for reducing the pressure in said enclosure relative to the pressure in the chamber of said housing so as to draw toner particles through said screen, said screen being substantially impervious to carrier granules so as to prevent the passage of carrier granules while permitting the passage of toner particles therethrough.

12. A printing machine according to claim 11, wherein said removing means includes means for vibrating said screen to free toner particles from carrier granules adjacent said screen.

13. A printing machine according to claim 12, wherein said removing means includes:

means for electrically biasing said screen to attract toner particles thereto from the developer material in the chamber of said housing; and means for assisting in the removal of toner particles from said screen.

14. A printing machine according to claim 13, wherein said assisting means includes a brush mounted rotatably in said enclosure and being adapted to contact said screen to dislodge toner particles therefrom.

15. A printing machine according to claim 14, wherein said assisting means includes means for electrically biasing said brush to attract toner particles from said screen.

16. A printing machine according to claim 15, wherein said removing means includes:

a bar positioned to engage said brush to dislodge toner therefrom; and an auger in communication with said enclosure to remove toner therefrom.

* * * * *